US006158601A

United States Patent [19]

Baker et al.

[11] Patent Number: 6,158,601

[45] Date of Patent: Dec. 12, 2000

[54] MODULAR MOBILE STORAGE SYSTEM

[75] Inventors: Edward A. Baker, Novi; Thomas M. Campau, Grosse Pointe Woods, both of Mich.

[73] Assignee: Denstor Mobile Storage Systems, Inc., Farmington Hills, Mich.

[21] Appl. No.: 09/170,241

[22] Filed: Oct. 13, 1998

[51] Int. Cl.[7] ..... A47F 5/00

[52] U.S. Cl. ..... 211/162

[58] Field of Search ..... 211/162, 40, 41.12, 211/94.01; 312/198–201; 403/231, 245

[56] References Cited

U.S. PATENT DOCUMENTS

| | | | |
|---|---|---|---|
| 2,915,195 | 12/1959 | Crosby | 312/199 |
| 3,762,335 | 10/1973 | Baker, Jr. et al. . | |
| 3,923,354 | 12/1975 | Young | 312/201 |
| 3,967,868 | 7/1976 | Baker, Jr. . | |
| 4,417,524 | 11/1983 | Quinn et al. . | |
| 4,427,244 | 1/1984 | Castagna . | |
| 4,547,026 | 10/1985 | French et al. | 312/201 |
| 4,549,777 | 10/1985 | Schindler | 312/198 |
| 4,618,191 | 10/1986 | Peterman . | |
| 4,708,411 | 11/1987 | Peterman . | |
| 4,789,210 | 12/1988 | Weiss et al. . | |
| 4,807,765 | 2/1989 | Brown et al. | 211/162 |
| 4,911,507 | 3/1990 | Leist . | |
| 5,013,101 | 5/1991 | Muth . | |
| 5,205,627 | 4/1993 | Davison et al. . | |
| 5,226,549 | 7/1993 | Price, Jr. et al. . | |
| 5,265,739 | 11/1993 | Price, Jr. et al. . | |
| 5,265,971 | 11/1993 | Duc | 403/231 |
| 5,403,109 | 4/1995 | Johnson et al. | 403/231 |
| 5,435,639 | 7/1995 | Smits et al. . | |
| 5,439,281 | 8/1995 | Croker . | |
| 5,597,217 | 1/1997 | Hoska et al. | 312/201 |
| 5,624,166 | 4/1997 | Theken et al. . | |
| 5,669,682 | 9/1997 | Janson . | |
| 5,683,155 | 11/1997 | Sarno . | |
| 5,685,664 | 11/1997 | Parham et al. | 403/231 |
| 5,823,700 | 10/1998 | Poworoznek | 403/245 |

OTHER PUBLICATIONS

Stacor, "Decked Lateral System", Aug. 1, 1991, pp. 4–5.

*Primary Examiner*—Daniel P. Stodola
*Assistant Examiner*—Jennifer E. Novosad
*Attorney, Agent, or Firm*—Harness, Dickey & Pierce, PLC

[57] ABSTRACT

A modular storage apparatus for movably supporting one or more storage units in front of a plurality of non-movably supported storage units. The apparatus comprises a plurality of independent, modular base sections each having a pair of tracks thereon which are securable together via cam lock coupling devices to form a single, rigid, lightweight, elongated base assembly. A leveling and supporting system associated with each base unit enables the entire base assembly to be precisely leveled. The base units each support at least one carriage unit which in turn supports an independent storage unit thereon. An anti-tip system prevents each movable storage unit from tipping or leaning beyond a predetermined degree. The modular construction enables the apparatus to be easily and conveniently shipped, packaged and handled and the assembled base assembly does not need to be secured to a supporting floor.

7 Claims, 4 Drawing Sheets

FIG 1
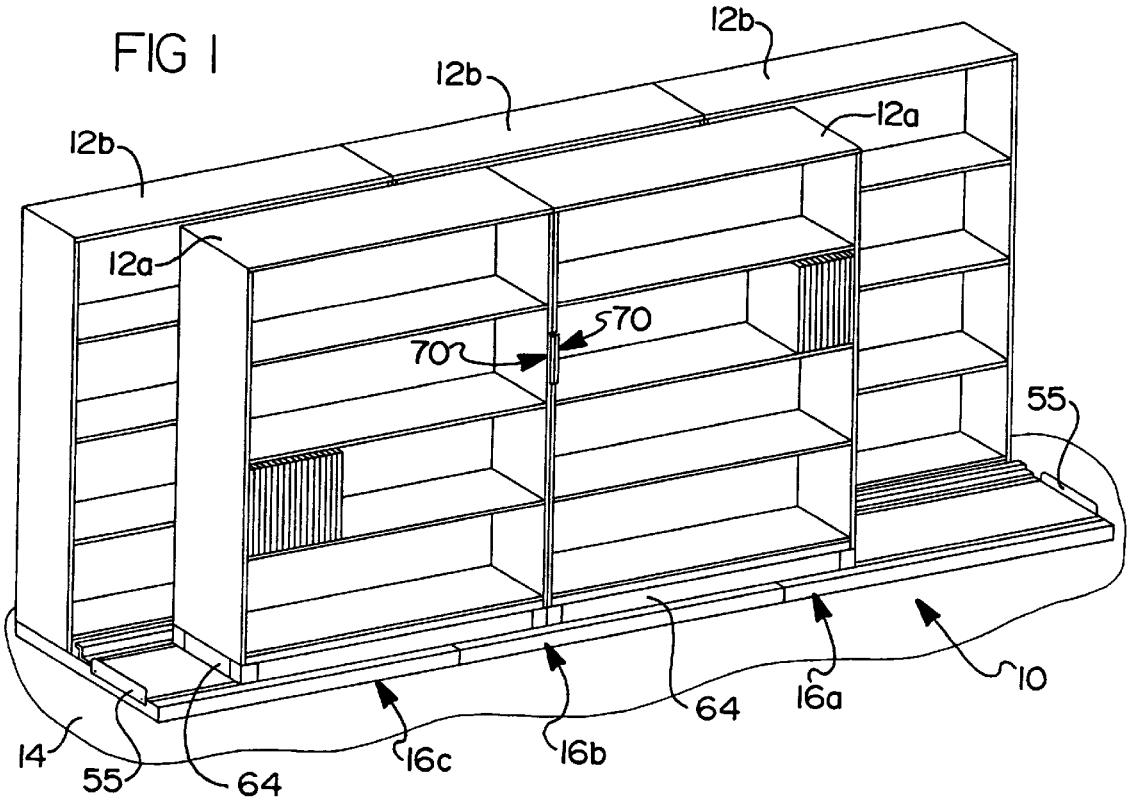
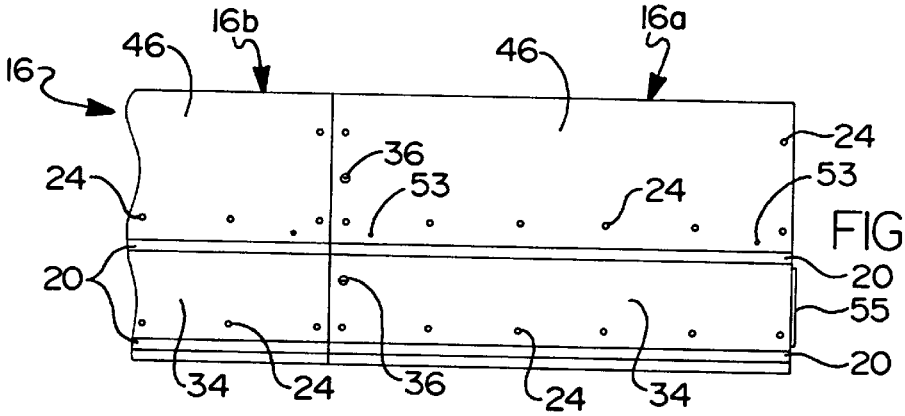
FIG 2A
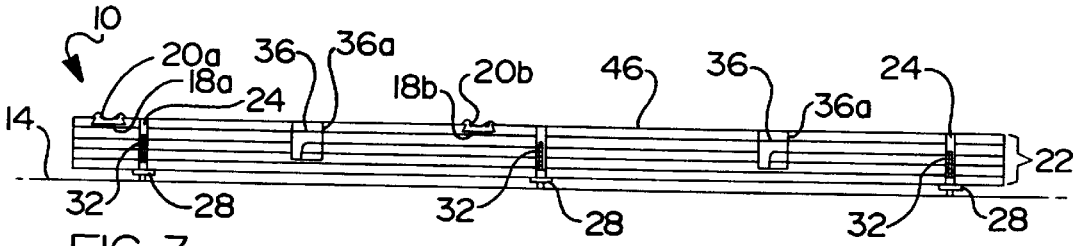
FIG 3

12a
16c
20a
20b
72
74
76
70
80
50
52
48
24
53
55
16a
34
36
36a
44
40
16b
42
46
3

FIG 4
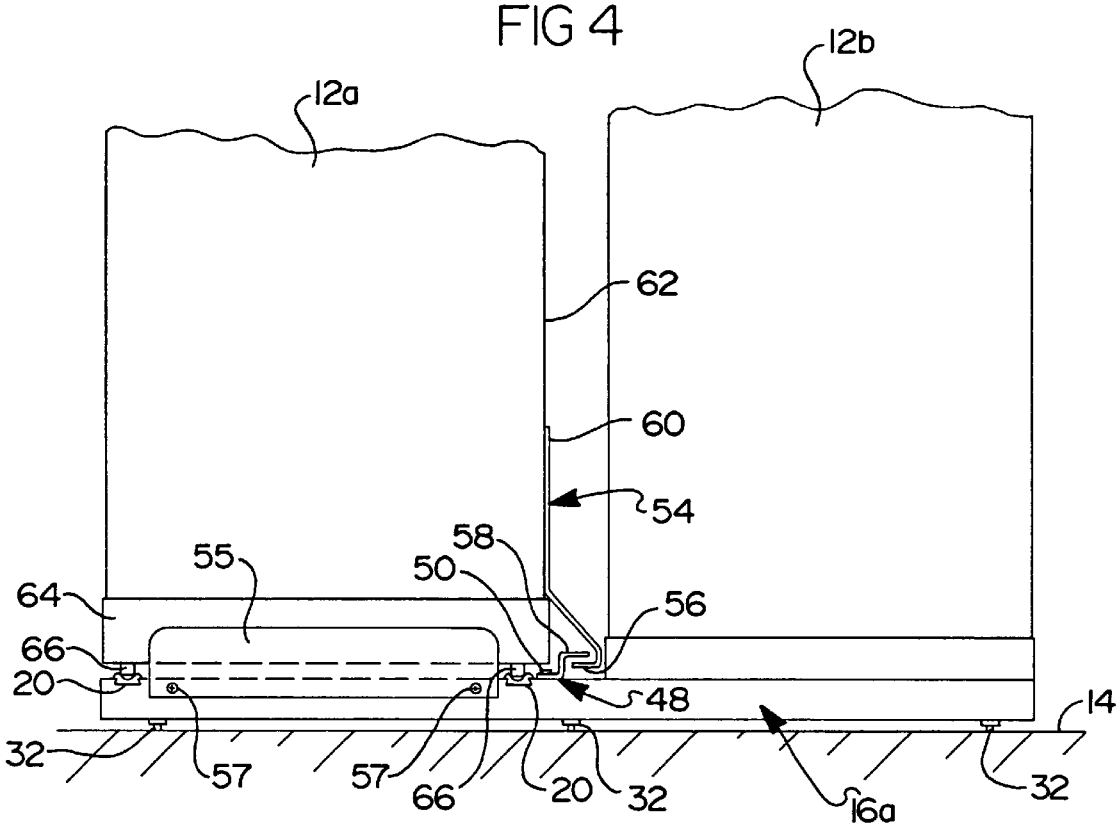
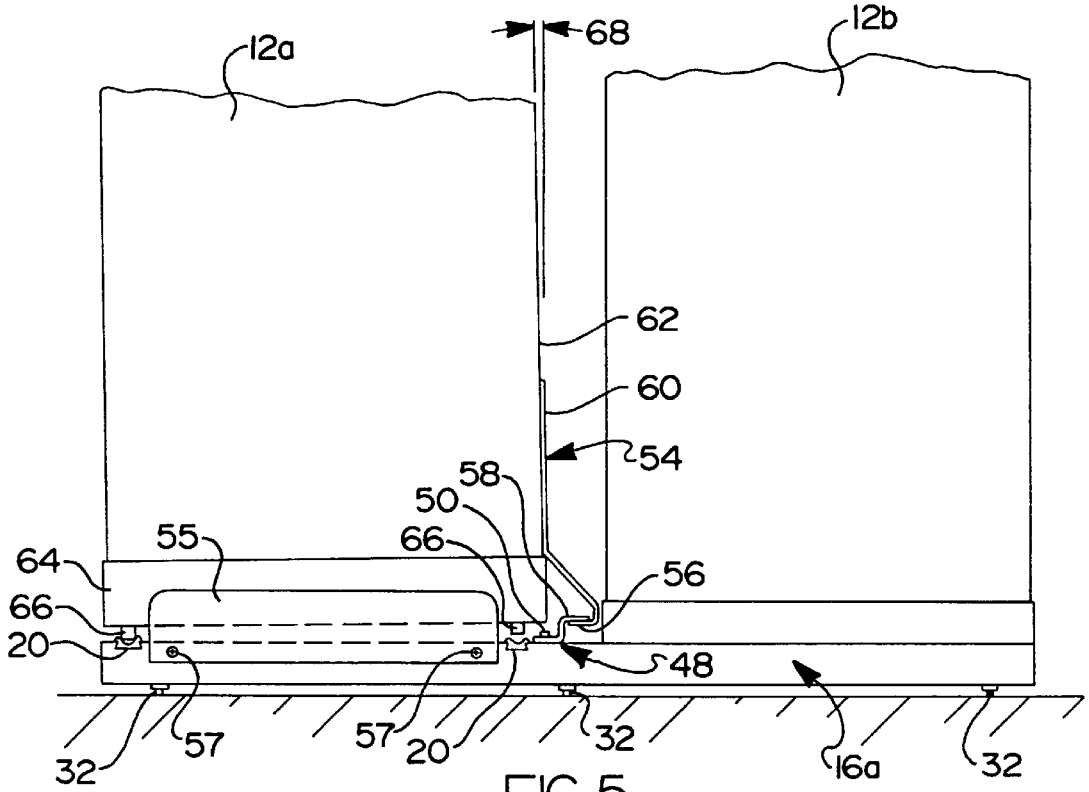
FIG 5

MODULAR MOBILE STORAGE SYSTEM

TECHNICAL FIELD

This invention relates to apparatuses for supporting storage units, and more particular an apparatus for movably supporting one or more storage units adjacent to a non-movably supported number of storage units, and where the apparatus incorporates an anti-tip rail system, a cost-efficient base construction, and a leveling/supporting system for easily and quickly leveling and supporting each of a plurality of base units once same are assembled together.

BACKGROUND

High density storage systems which support and allow for movement of a plurality of storage cabinets are used in applications where the storage space available in a given area is limited. Such systems typically are found in businesses for storing various items, and in libraries and in office environments such as accounting offices, medical offices, legal offices, etc. where a large number of files, books or other forms of documents need to be stored and yet easily accessible on a daily basis.

Previously developed storage systems have involved multiple base units that may be interconnected to form a single base assembly. Two or more non-movably supported storage units are supported on or adjacent to the assembled base units and a lesser number of movable storage units are placed on independent carriages, which ride on the assembled base unit, in front of the non-movably supported storage units. The movably mounted storage units may then be moved laterally as needed to gain access to the non-movably mounted storage units.

While the above-described system has proven to be an effective and useful system for high density storage purposes, improvements to this type of system would nevertheless further enhance its utility and reduce its overall cost. For example, it would be desirable to provide a construction for the base units that makes same more cost efficient to manufacture, more lightweight, and yet even more structurally rigid and strong. Such a strong and lightweight base assembly would be even easier to manufacture and package, and would permit the disassembled components to be shipped by a parcel service rather than by common carrier, thereby significantly reducing shipping costs. It would also be desirable to incorporate a coupling assembly with each base unit which provides for quickly and easily intercoupling each of the base units together with only a screwdriver. Such easy assembly would eliminate the need for highly trained installation personnel to assemble the base units.

Another improvement that would be highly desirable is an anti-tip system that forms an unobtrusive, low cost and easy to assemble means for preventing tipping or leaning of the movably mounted storage unit(s). Some previously developed anti-tip systems have involved components which extend over the top of the movable storage units and/or which have to be affixed directly to the carriages which support the movable storage units. It would be more desirable to provide an anti-tip system which has an anti-tip rail which can be quickly and easily secured to each base unit, and separate brackets which can be attached, without drilling and without threaded screws, directly to each of the movable storage units. This arrangement would provide an even easier to assemble and lower cost approach than many previously developed anti-tip systems and yet provide the maximum anti-tip resistance.

Still another improvement would be a levelling/supporting system which allows each of the base units to be levelled, after they are assembled together, more easily than with many prior levelling arrangements and with only an Allen wrench and a level.

SUMMARY OF THE INVENTION

The apparatus of the present invention is directed to a modular mobile storage system for supporting a plurality of movable storage units in a side-by-side relationship directly in front of a larger plurality of non-movably mounted storage units. The apparatus includes a plurality of independent, modular base units which each incorporate a coupling assembly allowing each of the modular base units to be intercoupled together to form a single, elongated base unit having excellent structural rigidity.

Each of the modular base units further includes a pair of parallel tracks. When each of the base units are intercoupled together, a pair of continuous tracks are formed along the entire length of the assembled base unit. The continuous tracks enable one or more independent carriage units, which each support an independent storage unit thereon, to be moved freely along the tracks as needed to provide access to the non-movably supported storage units.

In the present invention each base unit incorporates a laminated grid construction made from medium density fiberboard. This construction provides a base unit which is very structurally strong and rigid, and yet light in weight. The base unit further can be constructed with virtually no materials waste, making it very economical to manufacture. The excellent structural integrity helps to eliminate drift of the movable storage units resting thereon, as well as to enhance ease of movement of the movable storage units when it is needed to move one or more to gain access to the non-movably supported storage units.

In the present invention, the coupling assembly used for intercoupling the modular base units together comprises a conventional cam lock arrangement. At one edge of a first one of the modular base units at least one rotatable cam lock element is provided and at the mating edge of an adjacent modular base unit a grooved stud is provided. When the two modular base units are positioned in a side-by-side relationship with the grooved stud engaged in the cam lock element, a one-half rotation of the cam lock element will cause it to lock onto the grooved stud, thereby securely affixing the two modular base units to one another. In this manner a base assembly can be constructed having dimensions sufficient to accommodate the desired number of storage units, which can be assembled and disassembled quickly and easily and with only a screwdriver.

The modular base units further each include a leveling/supporting system which allows each base unit to be leveled relative to the adjacent base unit to which it is coupled. In this manner, the entire base assembly can be leveled and supported to accommodate floors which are slightly uneven and/or not perfectly level. The leveling system comprises a plurality of holes drilled in each of the base units and a corresponding plurality of T-nuts inserted in the holes. A threaded stud such as an Allen screw is then threadably inserted through each T-nut. Each modular base unit preferably comprises a number of threaded studs and corresponding T-nuts such that each base unit can be quickly and accurately leveled with only a level and a simple tool such as an Allen wrench.

The apparatus of the present invention also includes a novel anti-tip assembly for preventing tipping or leaning of the movably supported storage units without requiring attachment of the anti-tip system to the carriage units. The anti-tip system comprises a separate, generally Z-shaped rail which is secured to each of the modular base units during installation. A separate bracket is affixed to each one of the storage units along a rear portion thereof. Each bracket has an end portion which engages with one of the S-shaped rails in the event the storage unit begins to tip or lean to an unacceptable degree. When no tipping is occurring, the brackets do not engage the rails and the carriage units are free to move along the tracks in the base units.

Each of the preferred embodiments described herein enables a lightweight and easy to ship, modular storage system to be quickly and easily assembled with only very simple hand tools and without the need for cutting, drilling and other time consuming, noisy and dirt-generating installation procedures. The modular base units described herein, when assembled, form a lightweight, rigid and structurally strong base assembly. Also, if the storage units need to be removed and placed in a different area of an office, the base assembly can be quickly disassembled since it is not fixedly secured to the floor.

BRIEF DESCRIPTION OF DRAWINGS

The various advantages of the present invention will become apparent to one skilled in the art by reading the following specification and subjoined claims and by referencing the following drawings in which:

FIG. 1 is a perspective view of a laterally movable, modular storage system incorporating a plurality of non-movable storage units and a plurality of movable storage units disposed in front of the non-movable storage units, with all of the units being supporteon a base assembly of the apparatus of the present invention;

FIG. 2A is a fragmentary view of two of the base units coupled together;

FIG. 3 is a cross-sectional end view of one of the modular base units taken in accordance with section line 3—3 in FIG. 2 illustrating the modular base unit resting on afloor surface after being leveled;

FIG. 3*a* is a perspective view of a portion of one base member illustrating a T-member which is about to be press fit into an opening in the base member;

FIG. 3*b* is a perspective view of an exemplary cam lock system used with the base member;

FIG. 4 is an end view of the assembled base assembly illustrating a portion of the anti-tip system secured to a storage unit being supported on a carriage unit, and the rail of lie anti-tip system secured to one base unit;

FIG. 5 is a view of the anti-tip system shown in FIG. 4 illustrating how the anti-tip system prevents the storage unit to which it is secured from leaning or tipping beyond a predetermined degree from a vertical axis;

DETAILED DESCRIPTION OF PREFERRED EMBODIMENTS

Referring to FIG. 1, there is shown a modular storage apparatus 10 for supporting a plurality of storage units 12 on a floor surface 14. The storage units 12 are comprised of three stationary (i.e., non-movable) units 12B and a pair of movable front units 12A. Storage units 12A are positioned in side-by-side relationship to one another and in front of units 12B. Movement of storage units 12A laterally on the apparatus 10, as will be described further hereinafter, therefore allows access to each one of the rear storage units 12B. It will be appreciated that while only three nonmovable storage units 12B and two movable storage units 12A have been illustrated in FIG. 1, that the present invention is not limited to any particular number of storage units. To the contrary, it is a principal advantage of the modular construction of the apparatus 10 that the apparatus can be easily configured to accommodate a greater or lesser number of storage units 12 as needed. The only constraint is that a lesser number of movable storage units must be positioned in front of the non-movable storage units to thus permit access to each non-movable storage unit.

Figures 2, 6, 7:
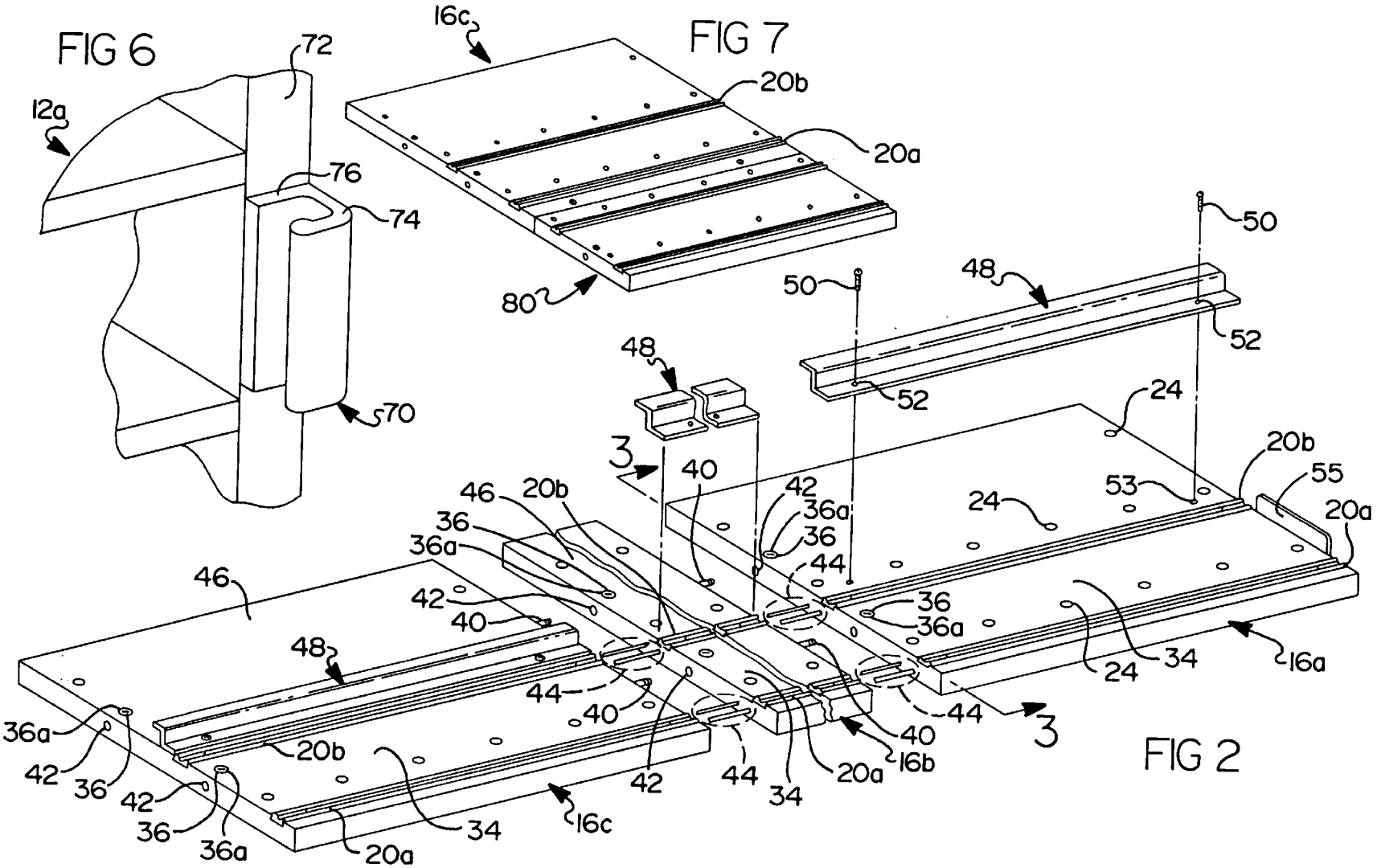
FIG. 2 is an exploded perspective, fragmentary view of three modular base units prior to intercoupling thereof.
FIG. 6 is an illustration of a portion of a movable storage cabinet having a handle attached thereto for assisting an individual in moving the storage unit on the base and FIG. 7 is a perspective fragmentary view of a half base unit coupled in front of a base unit of the present invention illustrating how the apparatus of the present invention can be modularly expanded to accommodate one or more additional rows of movable storage units.

Referring now to FIG. 2, the apparatus 10 includes a base assembly 16 which is formed by three independent (i.e., modular) base units 16A, 16B and 16C. With brief reference to FIG. 3, the base unit 16A is shown in cross-section, although it will be appreciated that the construction of base units 16B and 16C are essentially identical to base unit 16A. The base unit 16A includes a pair of parallel formed front and rear dove-tail grooves 18a and 18b. In the dove-tail grooves 18*a* and 18*b* are disposed a front track 20a and a rear track 20b, respectively, which in the preferred embodiment each comprise an extruded aluminum track.

With brief reference to FIG. 2A, each base unit 16A, 16B and 16C is constructed in a grid arrangement from several layers of medium density fiberboard (MDF) laminated together to form an extremely strong and flat member. The individual fiber board panels 22, when bonded together, form a particularly strong and rigid member capable of being easily machined with a drill and a router.

Figure 2B:
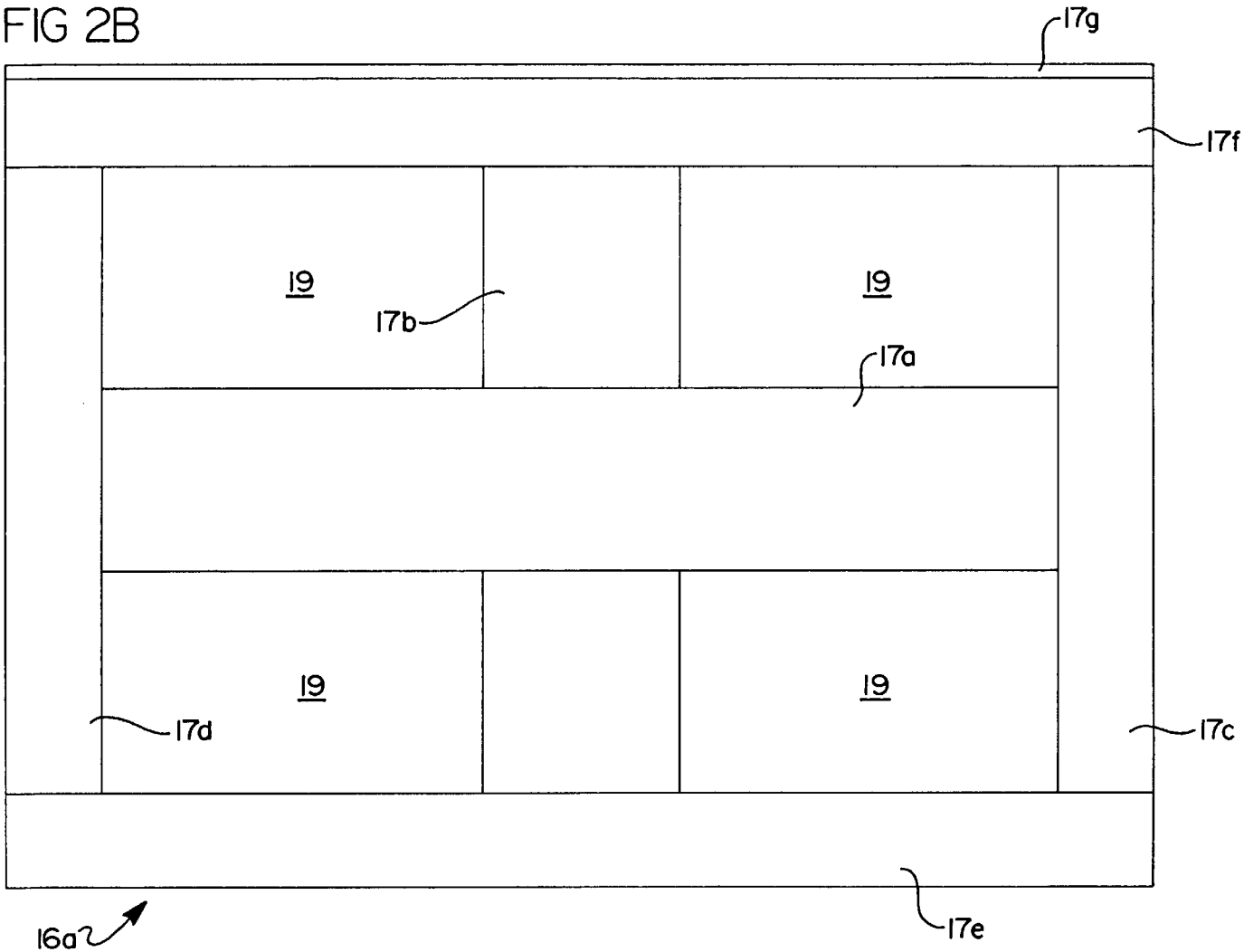
FIG. 2B is a plan view of the grid construction of one of the base units.

With reference to FIG. 2B, the grid arrangement of base unit 16A is illustrated. In this drawing figure it will be appreciated that the laminate covering which will normally be adhered to each surface of the base unit has been omitted so that the various panels used to form each base unit are clearly visible.

Each base unit 16A, 16B and 16C is formed from six laminated lengths of fiberboard 17*a*–17*f* adhered together to form a structurally rigid member. Open areas 19 help to produce a lightweight structure which is easier to handle and less costly to ship. A narrow length of fiberboard 17*g* is adhered to member 17*f* to form a backstop against which a non-movably supported storage unit 12B positioned on the base unit 16A is able to abut. In this regard it will be appreciated that the backstop 17*g*, strictly speaking, does not form part of the grid of the base unit 16A. Also, the backstop 17*g* protrudes above the upper surface of the base unit 16*a* slightly to enable it to abut the rear edge of a non-movably supported storage unit 12B being supported thereon. It will be appreciated that this grid construction and the use of medium density fiberboard enable the dimensions of each base unit 16A, 16B, 16C to be changed if needed during manufacture to support storage units having different dimensional footprints.

The grid arrangement allows each base unit to be manufactured with essentially no wasted fiberboard, thereby making the base units very cost efficient to produce. The light weight of each base unit further reduces the cost of shipping and enables the entire apparatus 10 to be easily handled and shipped by a parcel service rather than by common carrier. The grid construction enables fully loaded storage units typically weighing between 500 lbs.–1200 lbs. to be easily supported. With further reference to FIGS. 2 and 3, each base member 16A, 16B, 16C includes a leveling and support system comprised of a plurality of holes 24 drilled completely through the base unit. Preferably, for a base unit having a length of about 36 inches, these openings are spaced apart about every 6 inches and arranged in rows such that one row of openings is positioned along the front track 20*a* while another row of openings 24 is positioned along the rear track 20*b*. The openings 24 at each of the corners of each base unit 16A, 16B and 16C are used for levelling each base unit, as will be described momentarily, while the remaining openings are used for support purposes to help each base unit support the weight of a pair of fully loaded storage units. It will be appreciated that a greater or lesser number of holes could be provided for leveling and/or supporting purposes, depending on the overall dimensions of each base unit 16A, 16B, 16C.

With specific reference to FIGS. 3 and 3*a*, the leveling and support system further includes a plurality of threaded T-nuts 28. Each T-nut 28 is press fit into an opening 24 from a lower surface 30 of the base unit 16A. A threaded Allen screw or other like threaded stud 32 is threadably inserted through a threaded bore in the T-nut 28. Once all of the threaded Allen screws 32 are inserted, each base unit 16A, 16B and 16C can be leveled by adjusting the Allen screws 32 at the four corners thereof. The remaining Allen screws can be adjusted to account for undulations in the floor 14 to thus provide additional support. Advantageously, the Allen screws 32 are accessible from an upper surface 34 of each base unit 16A, 16B and 16C, and can therefore be adjusted even after the storage units 12A and 12B are placed on the base assembly 16 and loaded with files. This enables even further accuracy in the leveling process since the weight of the storage units 12A and 12B, when fully loaded, may interact with carpeting, carpet padding, etc., which the base assembly 16 is resting on to cause a small degree of unlevelling of the base assembly 16, if same was previously levelled without the loaded storage units resting thereon.

With further reference to FIGS. 2 and 3*b*, each base unit 16A, 16B and 16C includes a coupling assembly comprising a plurality cam lock members 36 disposed in openings 36*a* near at least one of the side edges 38 of the base units 16A and 16C, and two pairs of grooved studs 40 projecting outwardly from the side portions 38 of base units 16B and 16C. The studs 40 are aligned with and inserted into bores 42 formed in the side edges 38 of the base units 16A and 16B which open into the cam lock members 36. The grooved studs 40 extend through the bores 42 to interengage with the cam lock members 36 when the cam lock members are rotated one-half turn in one direction with a screwdriver. In this manner each base unit 16A, 16B, 16C can be securely attached to its adjacent base unit. Once assembled, base units 16A, 16B and 16C form a rigid yet relatively lightweight and structurally strong component which is highly resistant to bending and flexing. A portion of the assembled base unit 16 is shown in FIG. 2A. While not shown, it will be appreciated that one or more additional can lock members 36 could be included near a front edge 39 of each base unit 16A, 16B, 16C, with a corresponding plurality of bores 42. This would enable additional half base units to be added to expand the number of movable storage units 12A that can be accommodated.

It will be appreciated that depending upon the total number of independent components of the base assembly 16, the cam lock members 36 may not need to be provided at one edge or the other. For example, in FIG. 2, the cam lock members 36 located along the left most edge of base unit 16C would not be essential if the base assembly 16 was only intended to comprise three independent base units. However, providing such cam lock members 36 allows for the expansion of the base assembly 16 to include additional base units if the storage system needs to be increased in capacity at some future time. In that event, an additional base unit could easily be added as part of an add-on kit to either end of the base assembly 16 provided, of course, that the new base unit being added includes one edge having the projecting grooved studs 40 shown with base unit 16B. The cam lock members 36 and the grooved studs 40 are readily commercially available and widely used in various forms of furniture such as computer desks. This allows the base assembly 16 to be expanded as needed in the event more storage capacity becomes necessary after the apparatus 10 is initially installed.

With further reference to FIG. 2, the base assembly 16 may include a plurality of splice members 44 which essentially form short steel inserts to bridge the portions of the tracks 20 of adjacent base units which directly support the wheels of the carriage units used on the base assembly 16. Each splice member 44 is preferably within about two inches in length. Each base unit 16A, 16B and 16C may be shipped with short steel plugs, each about one inch in length, which may be left in the ends of the tracks 20 if the tracks do not need to be bridged to an adjacent pair of tracks 20. Obviously, such plugs would not need to be provided if it was known at the time of shipping the exact configuration of the base assembly. In that instance, if for example a three piece base unit was being provided, only the steel splice members 44 would need to be provided. The use of the splice members 44 insures that the carriage units which support the storage units 12A may roll freely from the tracks 20 of one base unit 16A, 16B, 16C onto the tracks 20 of the adjacent base unit.

An important advantage of the present invention is that the base assembly 16 can be quickly, easily and accurately levelled during installation. The Allen screws 32 are used to level the sections of the base assembly 16 to insure that the base assembly 16 is level. Since the base assembly 16 does not need to be fixedly secured to the floor 14, it is possible to easily disassemble and move the entire base assembly 16 to a different location if needed. Installation of the base assembly 16 is also significantly simplified because no drilling is required into the floor 14. This makes for a faster and easier installation of the apparatus 10 with no dirt and dust generating drilling being required.

Referring to FIG. 2, a portion of an anti-tip system is illustrated in the form of anti-tip rails 48. Each rail 48 is adapted to be secured to its associated base unit 16A, 16B or 16C near the rear track 20*b* thereof. The approximate rear half 46 of each base unit 16A, 16B and 16C supports one of the non-movable storage units 12B. For a base assembly comprising three base units such as shown in FIG. 2, three rails 48 will be included and attached to form a continuous, elongated anti-tip rail which extends in front of each of the non-movable (i.e., rear) storage units 12B.

Referring to FIGS. 2 and 4, the anti-tip rail 48 is secured via a plurality of screws 50 (only one being shown in FIG. 4) extending through openings 52 formed along the rail 48 and into holes 53 in its associated base unit 16A, 16B or 16C. The rail 48 forms a generally Z-shaped member and is preferably made from steel. A bracket member 54 is also included having a lower edge portion 56 which extends underneath a lip 58 of the rail 48. An upper portion 60 of the bracket member 54 is secured by a pressure sensitive adhesive to a rear edge 62 of the storage unit 12A which securely affixes the bracket member 54 directly to its storage unit. This provides the maximum anti-tip resistance and differs from previous systems which require attachment of some member directly to the carriage unit. The bond provided by the pressure sensitive adhesive is extremely strong and can easily withstand the momentary shear force experienced when its associated storage unit 12 begins to tip or lean if an individual should attempt to stand on a shelf of one of the movable storage units 12A or otherwise exerts a force that causes the storage unit to lean or tip. This anti-tip arrangement is far less obtrusive than other systems which involve members which protrude over the top areas of the storage units and complicate the assembly of the system. It will be appreciated, however, that the apparatus is extremely stable and that the movable storage units 12A do not have a tendency to tip or lean unless some external force is applied which tends to cause the tipping or leaning.

It will be appreciated that the storage unit 12A is supported on a carriage 64 having a plurality of pairs of rollers 66 for enabling the storage unit 12A to be moved along the tracks 20. The carriage 64 is well-known in the art. For further details on the construction of a suitable carriage, reference may be made to U.S. Pat. No. 4,597,615, the disclosure which is hereby incorporated by reference.

FIGS. 4 and 2 also illustrate a stop bracket 55 affixed securely, preferably by threaded screws 57, to the side edge 38 of the base unit 16A. Stop bracket 55 stops rolling movement of the storage unit 12A at the outer edge of the base unit 16A. An identical stop bracket is provided at the opposite end of the base assembly 16 to stop rolling movement of the carriage unit at the left most edge of base unit 16C in FIG. 1.

Referring now to FIG. 5, the anti-tip system formed by the rail 48 and the bracket member 54 is shown limiting the tipping movement of the storage unit 12A to only a slight degree from a vertical axis 68. The weight of the non-movable storage units 12B assists in holding the base assembly 16 firmly on the floor 14 even when one or more of the storage units 12A is tipping or leaning slightly.

Referring now to FIG. 6, a handle member 70 is illustrated secured to a front edge portion 72 of one of the storage units 12A. Two such handle members 70 are shown in FIG. 1. The handle member 70 has a graspable portion 74 and a base portion 76, with the base portion 76 being secured via a pressure sensitive adhesive to the front edge portion 72. The handle 70 enables the user to easily pull or push the movable storage unit 12A laterally as needed to gain access to the non-movably supported storage units 12*b*.

It will be appreciated that the apparatus 10 could be easily modified in numerous ways to provide for longer or shorter base units 16A, 16B and 16C or for a greater or lesser plurality of independent base units as needed. For example, FIG. 7 illustrates a half base 80 attached to the front edge 39 of base unit 16C. Since the half base only needs to support a movable storage unit, it only needs to be about half the width of the base unit 16C. In this manner, two rows of movable storage units 12A can be positioned in front of non-movable row of storage units 12B. Therefore, the apparatus 10 can be expanded both lengthwise and widthwise as needed to accommodate the changing storage needs of the business in which the apparatus 10 is being used.

Most importantly, however, the apparatus 10 forms a lightweight, easy to assembly and disassemble system which can be assembled without drilling or cutting tools. The modular, lightweight configuration of the apparatus 10 further enables the apparatus 10 to be shipped by a parcel service rather than by common carrier, which significantly reduces shipping and handling costs. The high structural integrity of the base units 16A, 16B, 16C serves to prevent drift of the carriage units while enhancing the ease with which each storage unit may be moved. The actual dimensions of each of the base units 16A, 16B and 16C can further be modified during manufacture to accommodate storage units of varying dimensional footprints.

Those skilled in the art can now appreciate from the foregoing description that the broad teachings of the present invention can be implemented in a variety of ways. Therefore, while this invention has been described in connection with particular examples thereof, the true scope of the invention should not be so limited since other modifications will become apparent to the skilled practitioner upon a study of the drawings, specifications and following claims.

What is claimed is:

1. A modular file cabinet supporting apparatus for supporting a first and second group of storage units, said first group of storage units including a plurality of non-movably supported independent storage units, said second group of storage units including a plurality of independent storage units movable relative to one another and in side-by-side fashion, said second group of storage units disposed in front of said first group of storage units, said apparatus comprising:

a plurality of independent, modular base units adapted to rest on said floor;

each of said base units having a planar, rigid platform and a pair of tracks fixedly secured to an upper surface of the platform which align to form two linear continuous tracks when said base units are coupled together, the platform not being required to be fastened to a floor structure supporting said storage units;

each of said base units having a coupling assembly for fixedly coupling each of said base units to at least one of the other base units widthwise;

each of said base units having a coupling assembly for fixedly coupling each of said base units to at least one of the other base units lengthwise;

said coupled base units forming a single elongated, planar base assembly having a desired length and width for supporting a desired number of a first group of said independent storage units in non-movable, side-by-side relationship to one another, and a second group of said independent storage units in side-by-side relationship in front of said first group of storage units, said single base assembly providing controlled linear movement of each one of said second group of independent storage units without interfering with said first group of independent storage units;

a plurality of independent carriage assemblies each associated with a single one of said storage units of said second group, for supporting each one of said storage units of said second group independently of the others, each of said carriage assemblies having a plurality of pairs of rollers adapted to engage with said continuous tracks when said carriage assemblies are disposed on said continuous tracks to enable each one of said storage units of said second group to be moved linearly independently of the others;

an anti-tip system including a rail associated with at least one of said base units and a bracket member affixed to at least one of said storage units of said second group, for cooperatively limiting tilting movement of said at least one said storage unit to a predetermined degree during operation thereof; and a leveling and supporting system for independently leveling each of said base units relative to each other, said leveling and supporting system including a plurality of openings formed in each of said base units, a plurality of T-members each having a threaded bore and being inserted in said openings, and a plurality of threaded studs engaged within said threaded bores in said T-members, said threaded studs being threadably adjusted independently of one another in order to level said base units.

2. The apparatus of claim 1, further comprising a handle member securable to at least one of said storage units for enabling said one storage unit to be slid manually along said continuous tracks.

3. The apparatus of claim 1, wherein said rail comprises a Z-shaped, elongated rail adapted to be fixedly secured to at least one pair of said base units.

4. A modular file cabinet supporting apparatus for supporting a first and second group of storage units, said first group of storage units including a plurality of non-movably supported independent storage units, said second group of storage units including a plurality of independent storage units movable relative to one another and in side-by-side fashion, said second group of storage units disposed in front of said first group of storage units, said apparatus comprising:

a plurality of independent, modular base units adapted to rest on said floor;

each of said base units having a planar, rigid platform and a pair of tracks fixedly secured to an upper surface of the platform which align to form two linear continuous tracks when said base units are coupled together, the platform not being required to be fastened to a floor structure supporting said storage units;

each of said base units having a coupling assembly for fixedly coupling each of said base units to at least one of the other base units widthwise;

each of said base units having a coupling assembly for fixedly coupling each of said base units to at least one of the other base units lengthwise;

said coupled base units forming a single elongated, planar base assembly having a desired length and width for supporting a desired number of a first group of said independent storage units in non-movable, side-by-side relationship to one another, and a second group of said independent storage units in side-by-side relationship in front of said first group of storage units, said single base assembly providing controlled linear movement of each one of said second group of independent storage units without interfering with said first group of independent storage units;

a plurality of independent carriage assemblies each associated with a single one of said storage units of said second group, for supporting each one of said storage units of said second group independently of the others, each of said carriage assemblies having a plurality of pairs of rollers adapted to engage with said continuous tracks when said carriage assemblies are disposed on said continuous tracks to enable each one of said storage units of said second group to be moved linearly independently of the others;

a handle member securable to at least one of said storage units for enabling said one storage unit to be slid manually along said continuous tracks;

an anti-tip system including a rail associated with at least one of said base units and a bracket member affixed to at least one of said storage units of said second group, for cooperatively limiting tilting movement of said at least one said storage unit to a predetermined degree during operation thereof; and a leveling and supporting system for independently leveling each of said base units relative to each other, said leveling and supporting system including a plurality of openings formed in each of said base units, a plurality of T-members each having a threaded bore and being inserted in said openings, and a plurality of threaded studs engaged within said threaded bores in said T-members, said threaded studs being threadably adjusted independently of one another in order to level said base units.

5. The apparatus of claim 4, wherein said rail comprises a Z-shaped elongated rail adapted to be fixedly secured to at least one pair of said base units.

6. A modular file cabinet supporting apparatus for supporting a first and second group of storage units, said first group of storage units including a plurality of non-movably supported independent storage units, said second group of storage units including a plurality of independent storage units movable relative to one another and in side-by-side fashion, said second group of storage units disposed in front of said first group of storage units, said apparatus comprising:

a plurality of independent, modular base units adapted to rest on said floor;

each of said base units having a planar, rigid platform and a pair of tracks fixedly secured to an upper surface of the platform which align to form two linear continuous tracks when said base units are coupled together, the platform not being required to be fastened to a floor structure supporting said storage units;

each of said base units having a coupling assembly for fixedly coupling each of said base units to at least one of the other base units widthwise;

each of said base units having a coupling assembly for fixedly coupling each of said base units to at least one of the other base units lengthwise;

said coupled base units forming a single elongated, planar base assembly having a desired length and width for supporting a desired number of a first group of said independent storage units in non-movable, side-by-side relationship to one another, and a second group of said independent storage units in side-by-side relationship in front of said first group of storage units, said single base assembly providing controlled linear movement of each one of said second group of independent storage units without interfering with said first group of independent storage units;

a plurality of independent carriage assemblies each associated with a single one of said storage units of said second group, for supporting each one of said storage units of said second group independently of the others, each of said carriage assemblies having a plurality of pairs of rollers adapted to engage with said continuous tracks when said carriage assemblies are disposed on said continuous tracks to enable each one of said storage units of said second group to be moved linearly independently of the others;

an anti-tip system including a rail associated with at least one of said base units and a bracket member affixed to at least one of said storage units of said second group, for cooperatively limiting tilting movement of said at least one said storage unit to a predetermined degree during operation thereof, said rail comprising a Z-shaped elongated rail adapted to be fixedly secured to at least one pair of said base units; and a leveling and supporting system for independently leveling each of said base units relative to each other, said leveling and supporting system including a plurality of openings formed in each of said base units, a plurality of T-members each having a threaded bore and being inserted in said openings, and a plurality of threaded studs engaged within said threaded bores in said T-members, said threaded studs being threadably adjusted independently of one another in order to level said base units.

7. The apparatus of claim 6, further comprising a handle member securable to at least one of said storage units for enabling said one storage unit to be slid manually along said continuous tracks.

* * * * *

UNITED STATES PATENT AND TRADEMARK OFFICE

CERTIFICATE OF CORRECTION

PATENT NO. : 6,158,601
APPLICATION NO. : 09/170241
DATED : December 12, 2000
INVENTOR(S) : Edward A. Baker and Thomas M. Campau It is certified that error appears in the above-identified patent and that said Letters Patent is hereby corrected as shown below:

Drawings 3a and 3b were omitted, please insert drawings as shown below.

FIG 3a

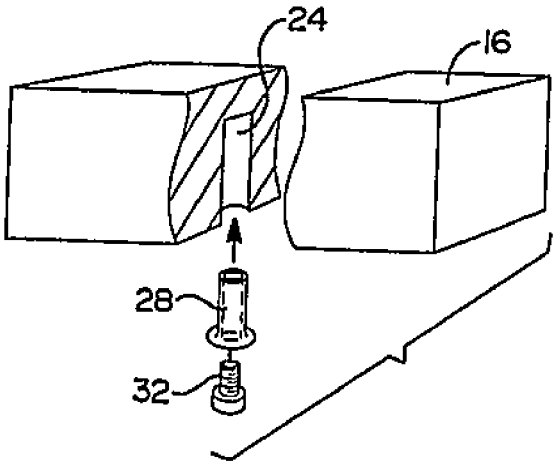

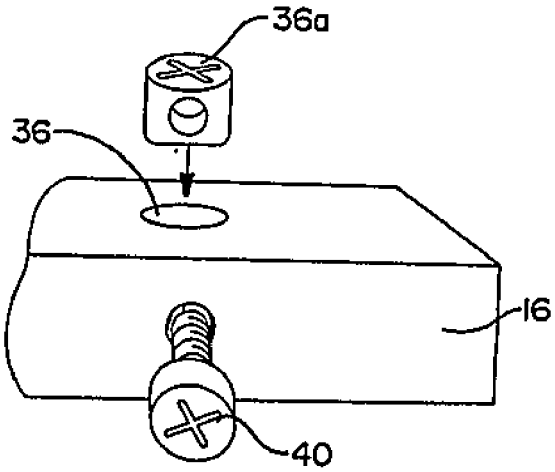

FIG 3b

UNITED STATES PATENT AND TRADEMARK OFFICE

CERTIFICATE OF CORRECTION

PATENT NO. : 6,158,601
APPLICATION NO. : 09/170241
DATED : December 12, 2000
INVENTOR(S) : Edward A. Baker and Thomas M. Campau It is certified that error appears in the above-identified patent and that said Letters Patent is hereby corrected as shown below:

Col. 1, line 22, after "yet" insert --are--
Col. 3, line 34, "supporteon" should be --supported on--.
Col. 3, line 44, "afloor" should be --a floor--
Col. 3, line 55, "lie" should be --the--
Col. 3, line 62, after "base" insert --assembly--
Col. 5, line 46, after "plurality" insert --of--
Col. 5, line 62, "can" should be --cam--
Col. 7, line 54, "units 12b" should be --units 12B--
Col. 8, line 2, delete "assembly" and substitute --assemble--
Col. 8, line 21, delete "specifications" and substitute --specification--

Signed and Sealed this

Twenty-fourth Day of July, 2007

JON W. DUDAS
*Director of the United States Patent and Trademark Office*